US007260451B2

(12) United States Patent
Takai et al.

(10) Patent No.: US 7,260,451 B2
(45) Date of Patent: Aug. 21, 2007

(54) AIR CONDITIONER MANAGEMENT SYSTEM AND CONVERTER UNIT THEREFOR

(75) Inventors: Tadashi Takai, Shimizu (JP); Masanori Takagi, Tokyo (JP); Yukio Ito, Abiko (JP); Makoto Itoh, Shimizu (JP)

(73) Assignee: Hitachi, Ltd., Tokyo, Japan, as Trustee for the Benefit of Hitachi Air Conditioning Systems Co., Ltd., Tokyo, Japan, Beneficiary, Tokyo (JP)

( * ) Notice: Subject to any disclaimer, the term of this patent is extended or adjusted under 35 U.S.C. 154(b) by 161 days.

(21) Appl. No.: 10/638,077

(22) Filed: Aug. 11, 2003

(65) Prior Publication Data

US 2004/0049320 A1 Mar. 11, 2004

Related U.S. Application Data

(62) Division of application No. 09/849,538, filed on May 7, 2001, now Pat. No. 6,647,317.

(30) Foreign Application Priority Data

Sep. 6, 2000 (JP) ..... 2000-274996

(51) Int. Cl.

| | |
|---|---|
| ***G05B 15/00*** | (2006.01) |
| ***G06F 15/16*** | (2006.01) |
| ***G05D 23/00*** | (2006.01) |
| ***F25B 41/00*** | (2006.01) |

(52) U.S. Cl. ..... 700/276; 700/55; 709/246; 62/157; 62/203

(58) Field of Classification Search ..... 700/9, 700/19, 55, 83, 276–278; 709/246; 62/126, 62/157, 203, 204

See application file for complete search history.

(56) References Cited

U.S. PATENT DOCUMENTS 4,470,140 A * 9/1984 Coffey ..... 370/400
(Continued)

FOREIGN PATENT DOCUMENTS

JP 2115957 * 4/1990
(Continued)

*Primary Examiner*—Leo Picard
*Assistant Examiner*—Sean Shechtman
(74) *Attorney, Agent, or Firm*—Antonelli, Terry, Stout & Kraus, LLP.

(57) ABSTRACT

A converter unit connected to a monitor apparatus for monitoring and controlling a plurality of air conditioners, including: PAC transmission software for transmitting a setting data from the monitor apparatus regarding a running start/stop state, a running node, an air quality and a temperature, respectively of the air conditioners, to a transmission path, and for receiving running data regarding a temperature and a pressure of a component during the refrigerating cycle from the transmission path; transmission software for receiving the setting data from the monitor apparatus and transmitting the running data to the monitor apparatus; and a converter to convert the running data for the PAC transmission software to a running data for the transmission software, and to convert the setting data for the transmission software to a setting data for the PAC transmission software, respectively, wherein the running data is collected from the control message at a predetermined interval, and the collected running data is transmitted to the monitor apparatus; and wherein the setting data is transmitted to the transmission path if the setting data is changed.

5 Claims, 6 Drawing Sheets

U.S. PATENT DOCUMENTS

| | | | | |
|---|---|---|---|---|
| 4,732,318 | A | 3/1988 | Osheroff | |
| 4,819,714 | A | 4/1989 | Otsuka et al. | |
| 4,997,029 | A | 3/1991 | Otsuka et al. | |
| 5,156,203 | A | 10/1992 | Funakoshi et al. | |
| 5,299,432 | A | 4/1994 | Nakae et al. | |
| 5,339,403 | A * | 8/1994 | Parker | 711/221 |
| 5,588,589 | A | 12/1996 | Ishihara et al. | |
| 5,605,058 | A | 2/1997 | Kurachi et al. | 62/503 |
| 5,684,463 | A | 11/1997 | Diercks et al. | |
| 6,126,080 | A | 10/2000 | Wada | |
| 6,131,134 | A * | 10/2000 | Huang et al. | 710/302 |
| 6,241,156 | B1 | 6/2001 | Kline et al. | |
| 6,263,260 | B1 | 7/2001 | Bodmer et al. | |
| 6,450,411 | B1 | 9/2002 | Rash et al. | |
| 6,454,177 | B1 | 9/2002 | Sasao et al. | |
| 6,487,457 | B1 | 11/2002 | Hull et al. | |
| 6,604,023 | B1 * | 8/2003 | Brown et al. | 700/276 |
| 2001/0055965 | A1 | 12/2001 | Delp et al. | |
| 2002/0035404 | A1 | 3/2002 | Ficco et al. | |
| 2002/0154057 | A1 | 10/2002 | Ueda et al. | |

FOREIGN PATENT DOCUMENTS

| | | |
|---|---|---|
| JP | 04-263737 | 9/1992 |
| JP | 4-292742 | 10/1992 |
| JP | 6-98381 | 4/1994 |
| JP | 9-79654 | 3/1997 |
| JP | 10-276483 | 10/1998 |
| JP | 11-102365 | 4/1999 |
| JP | 11-132539 | 5/1999 |
| JP | 11-23062 | 8/1999 |
| JP | 11-230602 | 8/1999 |
| JP | 11-264595 | 9/1999 |
| JP | 11-281132 | 10/1999 |
| JP | 11-344249 | 12/1999 |
| JP | 2000-082026 | 3/2000 |

* cited by examiner

FIG. 5

| HEADER FIELD | | | | | | | |
|---|---|---|---|---|---|---|---|
| ID CODE | TYPE CODE | LENGTH | SOURCE SERIES | SOURCE MACHINE | DESTINA-TION SERIES | DESTINA-TION MACHINE | |

| DATA FIELD | ERROR CHECKING DATA |
|---|---|
| VARIABLE DATA OF MAXIMUM 40 BYTES | |

FIG. 6

: BASIC FORMAT FROM INDOOR MACHINE TO OUTDOOR MACHINE

| 1-ST TO 7-TH BYTES | 8-TH BYTE | 9-TH BYTE | ··· | 18-TH BYTE | | 28-TH BYTE |
|---|---|---|---|---|---|---|
| HEADER FIELD | FFh = BASIC FORMAT | FUNCTION CODE | ··· | BLOW-OFF TEMPER-ATURE | | ERROR CHECKING DATA |

FIG. 7

: CHANGE DATA IN BLOW-OFF TEMPERATURE OF INDOOR MACHINE

| 1-ST TO 7-TH BYTES | 8-TH BYTE | 9-TH BYTE | 10-TH BYTE |
|---|---|---|---|
| HEADER FIELD | 09h CHANGE POSITION | BLOW-OFF TEMPER-ATURE | ERROR CHECKING DATA |

FIG. 8

RECEPTION OF BASIC FORMAT MESSAGE FROM MACHINE NO. 1 IN SERIES NO. 1

| HEADER FIELD | BASIC FORMAT | ERROR CHECKING DATA |
|---|---|---|

RECEPTION OF BASIC FORMAT MESSAGE FROM MACHINE NO. 1 IN SERIES NO. 2

| HEADER FIELD | BASIC FORMAT | ERROR CHECKING DATA |
|---|---|---|

DATABASE OF INDOOR MACHINE

| SERIES NO. / MACHINE NO. | 1 | | 2 | | 3 | | | 16 | |
|---|---|---|---|---|---|---|---|---|---|
| 1 | MACHINE TYPE INFORMATION | BASIC FORMAT | MACHINE TYPE INFORMATION | BASIC FORMAT | MACHINE TYPE INFORMATION | BASIC FORMAT | ... | MACHINE TYPE INFORMATION | BASIC FORMAT |
| 2 | MACHINE TYPE INFORMATION | BASIC FORMAT | MACHINE TYPE INFORMATION | BASIC FORMAT | MACHINE TYPE INFORMATION | BASIC FORMAT | ... | MACHINE TYPE INFORMATION | BASIC FORMAT |
| 3 | MACHINE TYPE INFORMATION | BASIC FORMAT | MACHINE TYPE INFORMATION | BASIC FORMAT | MACHINE TYPE INFORMATION | BASIC FORMAT | ... | MACHINE TYPE INFORMATION | BASIC FORMAT |
| ... | ... | ... | ... | ... | ... | ... | ... | ... | ... |
| 16 | MACHINE TYPE INFORMATION | BASIC FORMAT | MACHINE TYPE INFORMATION | BASIC FORMAT | MACHINE TYPE INFORMATION | BASIC FORMAT | ... | MACHINE TYPE INFORMATION | BASIC FORMAT |

DATABASE OF OUTDOOR MACHINE

| SERIES NO. / MACHINE NO. | 1 | | 2 | | 3 | | | 16 | |
|---|---|---|---|---|---|---|---|---|---|
| 1 | MACHINE TYPE INFORMATION | BASIC FORMAT | MACHINE TYPE INFORMATION | BASIC FORMAT | MACHINE TYPE INFORMATION | BASIC FORMAT | ... | MACHINE TYPE INFORMATION | BASIC FORMAT |
| ... | ... | ... | ... | ... | ... | ... | ... | ... | ... |

DATABASE OF REGENERATIVE UNIT

| SERIES NO. / MACHINE NO. | 1 | | 2 | | 3 | | | 16 | |
|---|---|---|---|---|---|---|---|---|---|
| 1 | MACHINE TYPE INFORMATION | BASIC FORMAT | MACHINE TYPE INFORMATION | BASIC FORMAT | MACHINE TYPE INFORMATION | BASIC FORMAT | ... | MACHINE TYPE INFORMATION | BASIC FORMAT |
| ... | ... | ... | ... | ... | ... | ... | ... | ... | ... |

※ CONTENTS IN BASIC FORMAT DEPEND UPON MACHINE TYPE

AIR CONDITIONER MANAGEMENT SYSTEM AND CONVERTER UNIT THEREFOR

CROSS REFERENCE TO RELATED APPLICATIONS

This application is a division of U.S. Ser. No. 09/849,538 filed 7 May 2001, now U.S. Pat. No. 6,647,317

BACKGROUND OF THE INVENTION

1. Field of the Invention

The present invention relates to a management system for the maintenance, management, control, service and the like of an air conditioner used in a composite facility such as a building and shop, and to a converter unit used for the management system. The converter unit is particularly suitable for Ethernet (registered trademark of Xerox Corporation in USA, network medium whose specifications are stipulated by IEEE) of the BACnet specification which is standardizing a communication protocol for a building management system (A Data Communication Protocol for Building Automation and Control Networks: ANSI/ASHRAE Standard 135-1995).

For multi air conditioners in building and the like, large system requirements, energy savings, management cost savings, new services, new needs and the like are highly concerned. Control information and the like of an air conditioner are now used in an open network system. For example, as described in JP-A-9-79654, running data of an air conditioner is transmitted via a gateway to a network to perform diagnosis of a running state, control and the like of the air conditioner at a centralized controller. For example, as described in JP-A-11-230602, information on a running state of an air conditioner is collected and allowed to be browsed via the Internet.

According to the above-described conventional techniques, since control information and the like of an air conditioner are used in an open network, there is a close affinity with standardization and building facilities. However, it is still not satisfactory in terms of changing a small management system to a large system with expected investment effects, system configuration, satisfying various user needs, system sharing, feasibility of system expansion and the like.

SUMMARY OF THE INVENTION

It is an object of the present invention to make it easy to connect an air conditioner to another system and provide an open network environment, a multi vendor system, highly efficient management, and improved services. It is an another object of the invention to provide a management system for an air conditioner excellent in system expendability, maintenance and reliability irrespective of a system scale and a converter unit to be used with the management system. The management system has a high degree of freedom allowing a user to develop an application in each field.

In order to solve the above problems, the invention provides a management system for an air conditioner, the management system having a monitor apparatus for monitoring and controlling an air conditioner, comprising: a status database for storing collected running data of the air conditioner; and a setting database for storing setting data of the air conditioner, the setting data including data regarding a running stop state, a running mode, an air quantity and a temperature, respectively of the air conditioner, wherein the running data stored in the status database is read to monitor the air conditioner and the setting data is rewritten to control the air conditioner.

It is preferable that the management system further comprises a terminal apparatus which reads the running data and rewrites the setting data via the Internet.

It is preferable that the management system further comprises a Web server having the status database and the setting database written in a hyper text format.

The invention also provides a management system for an air conditioner, the management system having a monitor apparatus for monitoring the air conditioner having an indoor machine and an outdoor machine, comprising: PAC transmission software for transmitting setting data to a transmission path connected to the indoor machine and the outdoor machine and receiving running data from the transmission path; transmission software for receiving the setting data from the monitor apparatus and transmitting the running data to the monitor apparatus; and a converter for performing data conversion between the PAC transmission software and the transmission software, wherein the running data is transmitted to the monitor apparatus at a predetermined interval and the setting data is transmitted to the transmission path if the setting data changes.

It is preferable that the setting data is data regarding a running stop state, a running mode, an air quantity and a temperature, respectively of the air conditioner.

It is preferable that the transmission software is associated with a USB interface.

The invention further provides a converter to be used by a management system for an air conditioner and connected to a monitor apparatus, the air conditioner having an indoor machine and an outdoor machine, the converter comprising a USB interface wherein running data of the air conditioner is transmitted via the USB interface at a predetermined interval, and setting data to be used as a control signal for the air conditioner is transmitted to a transmission path connected to the outdoor machine and the indoor machine.

It is preferable that the setting data is data regarding a running start/stop state, a running mode, an air quantity and a temperature, respectively of the air conditioner, and a drive frequency of a compressor of the outdoor machine and an opening degree of each expansion valve of the outdoor machine and the indoor machine are protected so as not to be controlled.

The present invention further provides a medium storing a program for realizing a monitoring and controlling function of a management system for an air conditioner having an outdoor machine and an indoor machine, wherein the program realizes: a function of receiving running data of the air conditioner and forming a database of the running data; a function of storing setting data regarding a running start/stop state, a running mode, an air quantity and a temperature, respectively of the air conditioner; and a function of transmitting the stored setting data to the air conditioner if the stored setting data changes.

The present invention further provides a program to be used with a management system for an air conditioner having an outdoor machine and an indoor machine, wherein the program realizes: a function of receiving data from the air conditioner and forming a database; a function of storing setting data of the air conditioner; and a function of transmitting the stored setting data to the air conditioner if the stored setting data changes.

BRIEF DESCRIPTION OF THE DRAWINGS

FIG. 5 is a diagram showing a format of a message on a transmission path according to an embodiment of the invention.

FIG. 6 is a diagram showing a basic format of data to be transmitted from an indoor machine to an outdoor machine according to an embodiment.

FIG. 7 is a diagram showing change data of a blow-off temperature at an indoor machine according to an embodiment.

FIG. 8 is a diagram showing databases according to an embodiment.

DETAILED DESCRIPTION OF THE EMBODIMENTS

Embodiments of the invention will be described in detail with reference to FIGS. 1 to 8.

Figure 1:
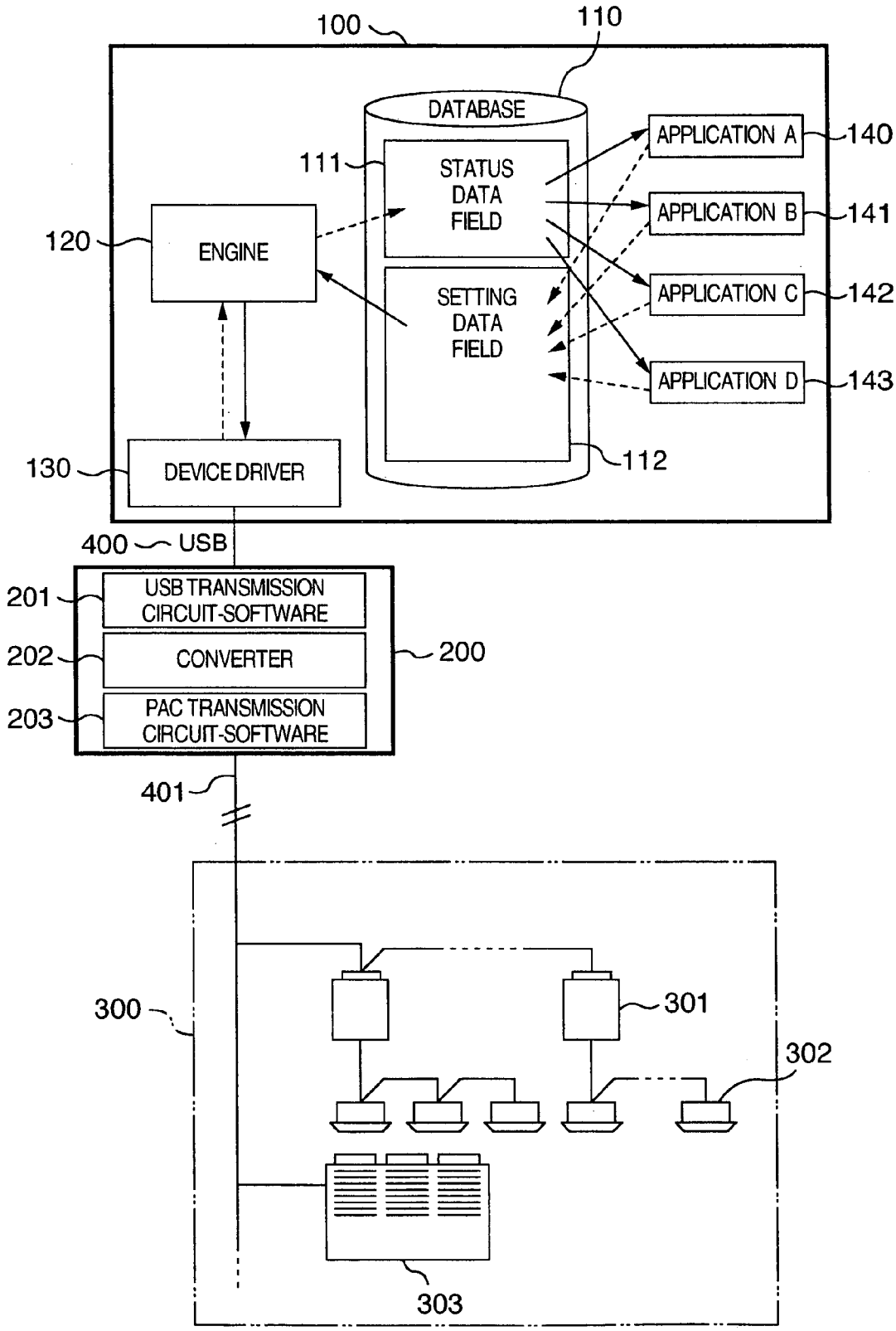
FIG. 1 is a block diagram showing a management system according to an embodiment of the invention.

FIG. 1 is a block diagram showing the structure of a management system for an air conditioner. Referring to FIG. 1, a personal computer 100 used as a monitoring apparatus is connected via a converter unit 200 to an air conditioner 300 to be monitored or controlled.

The air conditioner 300 has a plurality of outdoor machines 301, a refrigerator or chiller machine 302, 303 and a plurality of indoor machines, respectively interconnected by transmission paths via which data is transferred to control these machines. The outdoor machine 301 includes a compressor whose capacity is controlled by varying a drive frequency, for example, by an inverter, an outdoor heat exchanger, an electronic expansion valve and the like. A pressure sensor for detecting a discharge gas pressure and a temperature sensor for detecting a temperature are mounted on a discharge pipe of the compressor. The indoor machine has an indoor heat exchanger and an electronic expansion valve, and is connected to the outdoor machine via a refrigerant circulating path to constitute a refrigerating cycle.

The start/stop, running mode, air quantity, temperature and the like of the air conditioner can be controlled by using a remote controller or centralized controller connected to the air conditioner. For example, when a cool running is designated by the remote controller, a condensation temperature is calculated from a pressure value detected with the pressure sensor of the outdoor machine and compared with a temperature detected with the temperature sensor. From this comparison result, a total opening degree of electronic expansion valves corresponding to an optimum refrigerant quantity is calculated, and in accordance with this total opening degree, the opening degree of the electronic expansion valve of each indoor machine is controlled. During a high load operation, the inverter controls the compressor to run it at high rotation speed, and as the load reduces, the inverter controls the compressor to run it at lower rotation speed.

Figure 4:
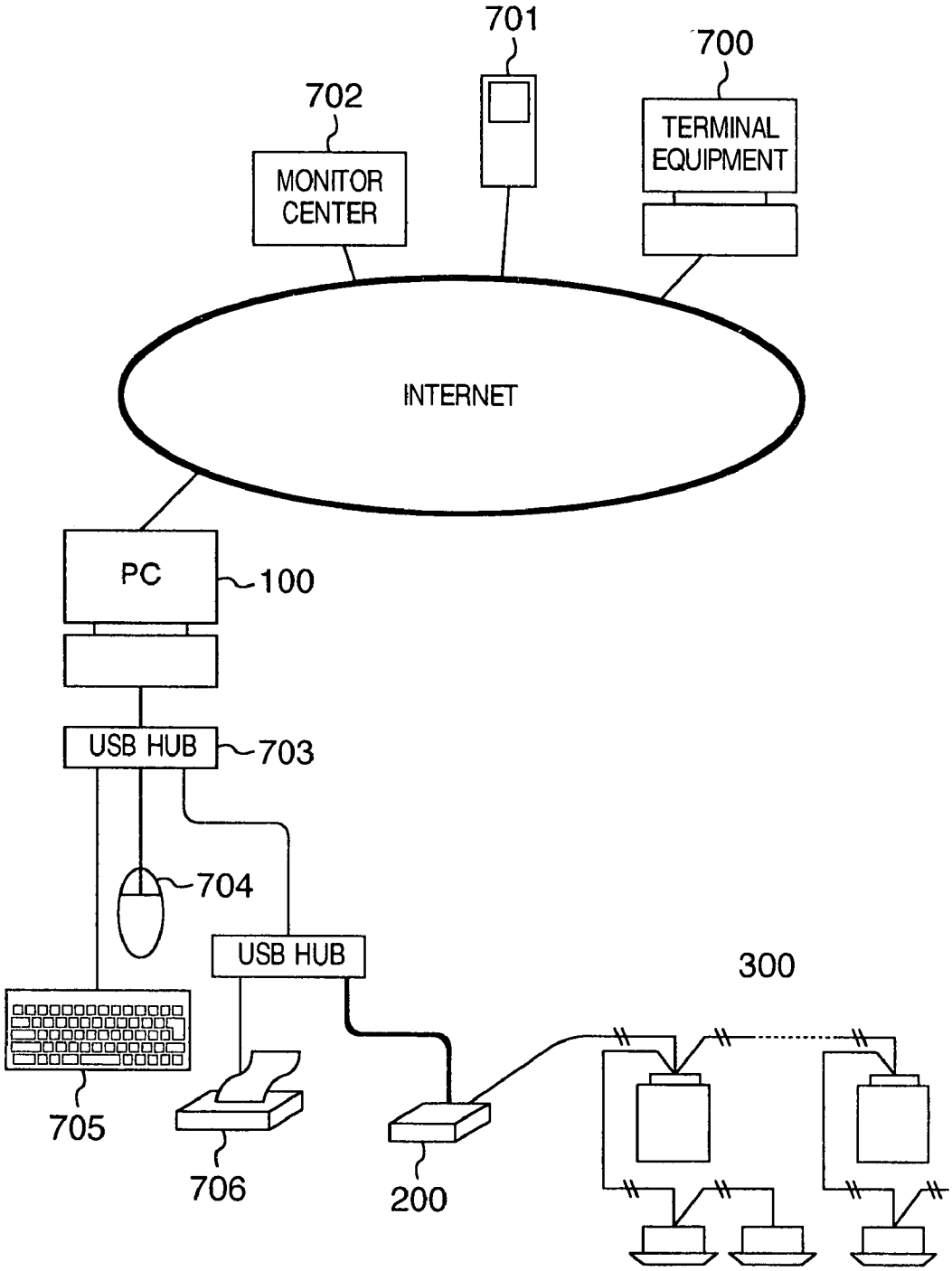
FIG. 4 is a diagram showing a whole management system according to an embodiment of the invention.

The personal computer 100 is connected to the converter unit 200 via a USB (universal serial bus) 400, and the converter unit 200 is connected to the air conditioner 300 via a transmission path 401. The converter unit 200 has transmission software 201 for data transfer to and from the personal computer 100 via USB 400, PAC transmission software 203 for data transfer to and from the air conditioner 300, and a converter 202 for data conversion between the personal computer and air conditioner. Since the converter unit 200 uses an USB interface, as shown in FIG. 4 peripheral apparatus of the personal computer 100 such as a keyboard 705, a mouse 704 and a printer 706 can be simply installed and disconnected by using an USB hub 703 without turning off the power supply of the personal computer 100, and the newly installed apparatus can be automatically detected (Hot Plug, and Plug & Play). Since the converter unit 200 uses the USB interface, its power can be supplied from USB.

The personal computer 100 has: a database 110; a device driver 130 for data transfer to and from the converter unit 200 by USB; a software engine 120 and an application programs 140 to 143 which use the database 110. The database 110 stores therein running data of the air conditioner (eg., temperatures, pressures and the like of main components during the refrigerating cycle, such as suction pressure, discharge pressure, compressor upper temperature, outdoor machine expansion valve opening degree, indoor machine expansion value opening degree, compressor current, compressor frequency, outdoor temperature, evaporation temperature, suction temperature, blow-off temperature, freezing temperature, requested frequency, gas tube temperature, and setting temperature). The software engine 120 collects running data and control data of each machine via the device driver 130 and transfers data to and from the database 110.

Each application accesses the database 110 to monitor and control the air conditioner. If the application requires data of the air conditioner 300, the application accesses a status database 111 of the database 110 to acquire the data and monitor the air conditioner from the acquired data. When the application controls the air conditioner 300, control contents in a setting database 112 of the database 110 are rewritten so that the application can control an indoor machine of a desired No. in a desired series (such as start/stop, running mode, air quantity, temperature and louver position, respectively settable with a remote controller). By limiting the access conditions to the database, each application is permitted to perform particular functions, such as only monitor for an application A and both monitor and control for an application B.

The engine 120 transmits a basic format request message to each machine connected to the transmission path 401 via the device driver 130 and converter unit 200, at a predetermined interval, e.g., regularly (at interval of one minute), and the engine 120 receives the running data and control data of each machine. When data in the setting data field 112 changes, the changed data is converted into a control message which is transmitted to the transmission path 401 via the device driver 130 and converter unit 200, and ultimately to a specific machine.

The engine 120 derives a data field from a message acquired via the transmission path 401 and stores it in the status database having the structure shown in FIG. 8. Referring to FIG. 8, as shown in the upper area of FIG. 8, the database of the indoor machine is arranged by using a series No. representative of which outdoor machine the indoor machine is connected and a machine No. in the series. Machine type information and data of the basic format are stored in respective fields of the database. Similarly, as shown in the middle and lower areas of FIG. 8, the databases of the outdoor machine and regenerative unit are arranged by using the series No. and machine No.

A message on the transmission path 401 has the format such as shown in FIG. 5. Each message has essentially a header field and error checking data, and data of the remaining 40 bytes is set in the form specific to each machine. Since each machine has a unique series No. and a unique machine No., it is possible to transmit a message (called an individual message) to a specific machine by setting information (ID code, type code, source series No., source machine No., destination series No., destination machine No.) in the header field. If FFh is set to the destination machine No. field, a message (called a broadcast message) can be transmitted to all machines without limiting the destination.

Each machine connected to the transmission path 401 transmits a response message in response to a request message and change data under the condition of, e.g., a predetermined interval. The response message in response to a current control data request message (basic format request message) received from another machine, e.g., a response message from an indoor machine to an outdoor machine, has the basic format such as shown in FIG. 6.

When control data under management of each machine changes (e.g., when a blow-off temperature at an indoor machine changes or when an alarm is detected), the change data is transmitted. As shown in FIG. 7, the change data is a set of the position of the data: 09 (the change position, the eighth byte in FIG. 7), which is counted from the tenth byte of the basic format disregarding from the first byte to the ninth byte, and the change data contents: the blow-off temperature (the ninth byte in FIG. 7). When a plurality of the data change simultaneously, as one example, a maximum of 20 change data can be transmitted.

Each outdoor machine requests the basic format to the indoor machine by transmitting the request message at a predetermined interval. Between an indoor machine and an outdoor machine, control data is exchanged by using the basic format and change data. The control information includes information on suction pressure, discharge pressure, compressor upper temperature, outdoor machine expansion valve opening degree, indoor machine expansion valve opening degree, compressor current, compressor frequency, outdoor temperature, evaporation temperature, suction temperature, blow-off temperature, freezing temperature, requested frequency, gas tube temperature, and setting temperature. In accordance with the exchanged control data, a microcomputer mounted on a control board of each machine determines the control contents to control the machine.

Between an indoor machine and a centralized controller, control information is exchanged by using the basic format and change data. The control information includes information on start/stop, running mode, air quantity, temperature, louver position, suction temperature, blow-off temperature, alarm and the like). The centralized controller displays control data collected from each indoor machine to a user, and transmits setting values entered by a user to each indoor machine.

In accordance with the setting values, a microcomputer mounted on a control board of each indoor machine determines the control contents to control each indoor machine.

If the acquired data is the basic format, the engine 120 overwrites and updates the data in a storage area of the machine, whereas if the acquired data is the change data, it overwrites and updates only the change data in a storage area of the basic format.

Figure 2:
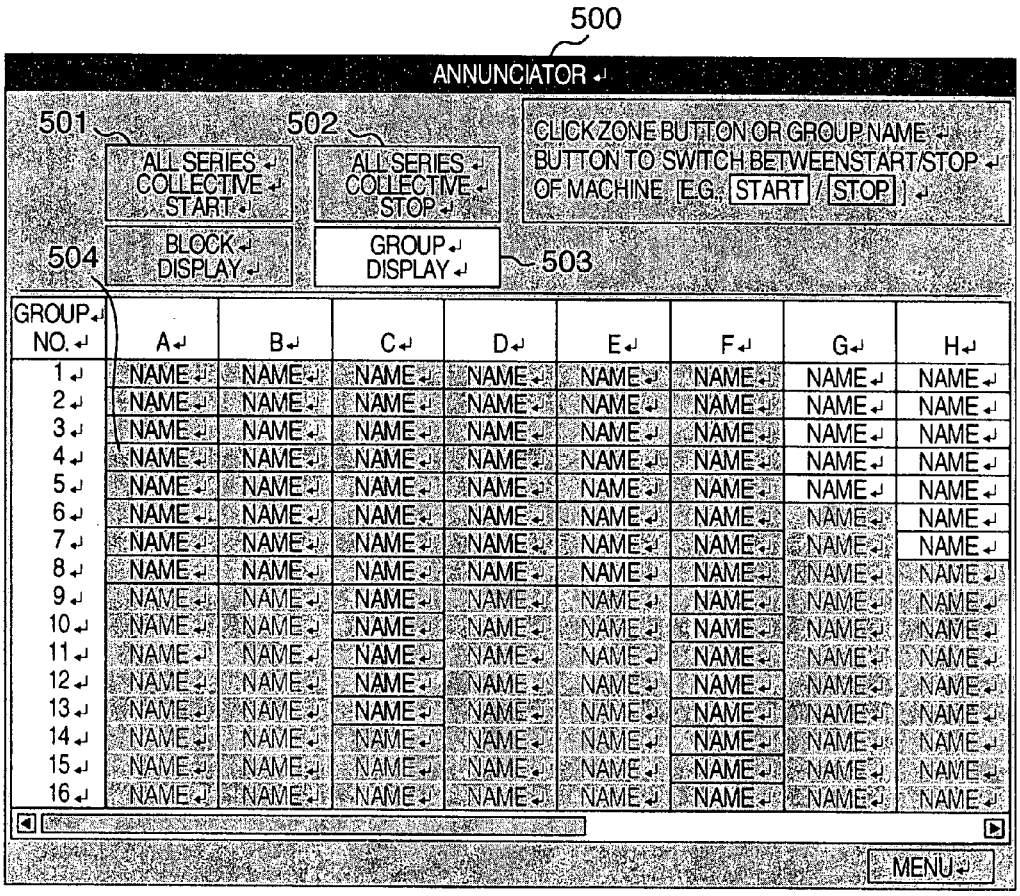
FIG. 2 is a diagram showing a common start/stop display window according to an embodiment of the invention.

FIG. 2 is a diagram showing an example of an operation window 500 displayed by the application programs 140 to 143. A user registers beforehand each group of a plurality of air conditioners by using a group No. A start/stop button 504 with its group name is displayed on the window in the unit of a group. When this button is clicked with a mouse, a start/stop instruction for this group is written in the setting database 112 to start controlling the group. Namely, when the instruction is written, a change in data of the setting database 112 is notified to the engine 120. The engine 120 converts the change data into a control message and transmits it over the transmission path 401 via the device driver 130 and converter unit 200. In accordance with the transmitted message, indoor and outdoor machines belonging to the corresponding group are controlled by corresponding microcomputers.

However, the data to be transmitted is limited, for example, to those data for setting the start/stop, running mode, air quantity and temperature of the air conditioners, so that the drive frequency of a compressor of the outdoor machine and the opening degrees of the expansion valves of indoor and outdoor machines are protected so as not to be controlled. With this protection, it is possible to control the air conditioner so as not to become outside of the initial settings of necessary functions of the air conditioner, such as the drive frequency thereof.

Start/stop of all air conditioners can be controlled by an all series collective start button 501 or an all series collective stop button 502, and display can be changed by a block display button or a group display button 503.

Figure 3:
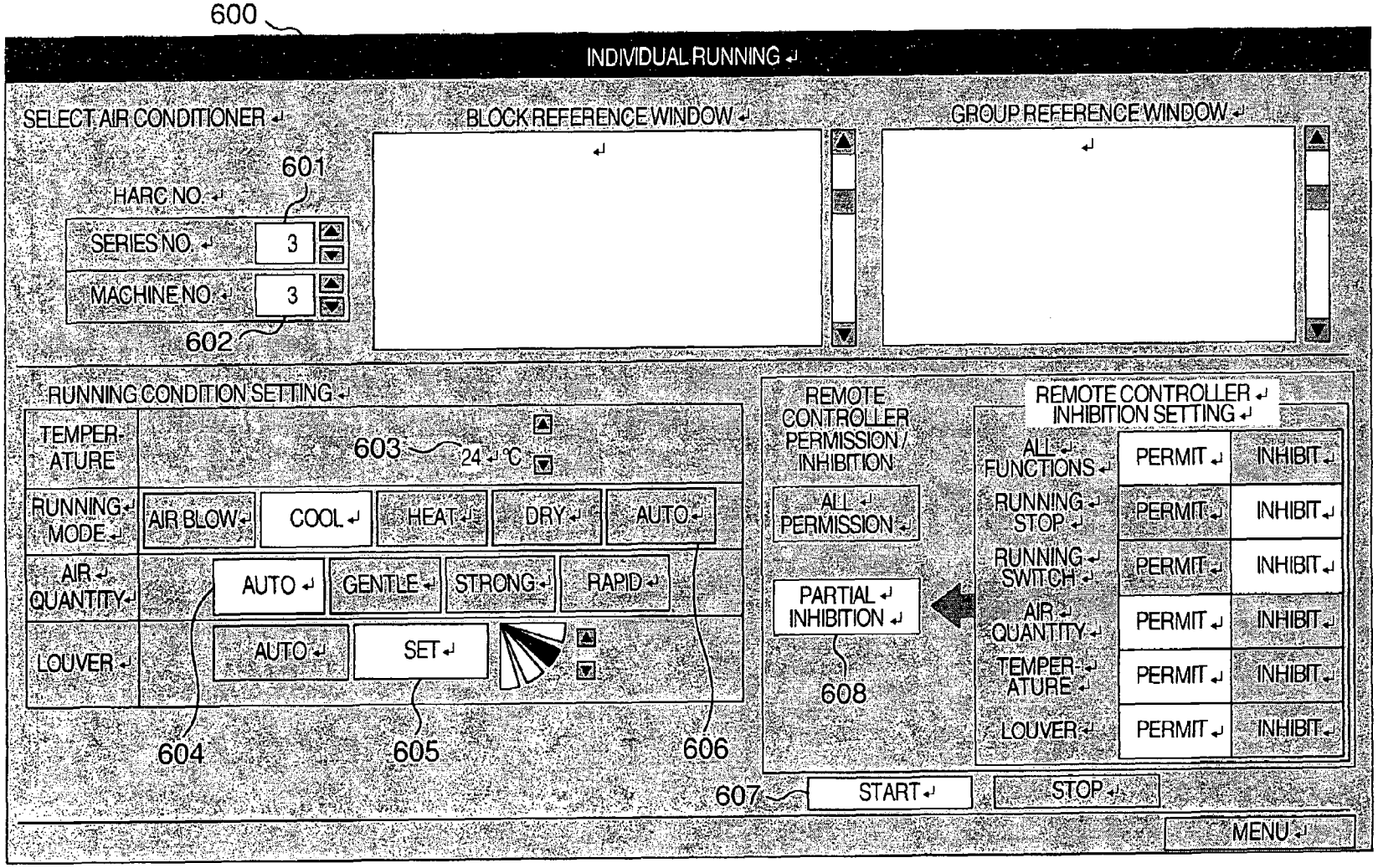
FIG. 3 is a diagram showing an individual control display window according to an embodiment of the invention.

FIG. 3 is a diagram showing an example of an operation window 600 displayed by the application programs 140 to 143 at each air conditioner. A user selects a desired air conditioner to be controlled, by using a series select menu 601 and a machine select menu 602 in an individual running control display window 600. The selected air conditioner can be set to a desired running state by using buttons such as a temperature button 603, an air quantity button 604, a louver position button 605, a running mode button 606, a start-stop button 607, a remote controller permission/inhibition button 608.

The running condition settings are performed for temperature, running mode, air quantity, louver and the like. The set temperature is displayed by a numerical value which can be changed by clicking up/down buttons. The running condition is set by clicking displayed buttons such as for air blow-off, cool, heat, dry and auto. The air quantity is set by clicking displayed buttons such as for auto, gentle, strong, and rapid. For the louver setting, buttons such as for auto and set are provided and a simulated image representative of the louver direction is displayed. When the air direction is to be set, the set button is clicked while the simulated image changes with the actual motion of the indoor machine louver. As the set button is clicked, the simulated image stops and this direction corresponds to the actual direction of the louver. For the remote controller permission/inhibition setting 608 and the like, as shown in FIG. 3, items including all functions, running stop, running switch, air quantity, temperature, and louver are displayed and corresponding permission/inhibition buttons are provided.

If the currently set items are required to be displayed, the application reads the data in the status database 111 and displays it on the window. If a process of converting data in the database of the air conditioner into data compatible with the standard protocol such as BACnet is provided, the platform can be easily transmitted to an open network environment.

Particular measurement values and control amounts are derived from the database to edit and display them as a table, graph or the like. The cycle state of an air conditioner is automatically analyzed from acquired data to display the analysis results and control methods to a user.

As shown in FIG. 4, the personal computer 100 as the monitor apparatus is connected to the Internet to which a terminal equipment 700, a cellar phone 701 (or personal digital assistance (PDA) and a monitor center 702 are connected. The cellar phone 701 can receive a mail and browse home pages. The monitor center 702 analyzes and monitors running data to detect any abnormality and perform maintenance and check of the management system. The terminal equipment 700, cellar phone 701 and monitor center 702 read running data and update the setting data. If the personal computer 100 is used as a Web server having the status database 111 and setting database 112 written in the hyper text format, another personal computer 700, cellar phone 701 and the like having a browser can browse data of the air conditioner and can control it. With this arrangement, data can be received quickly and shared not only by users of the air conditioner but also by building owner, maintenance person, maintenance company, maintenance and management section, design section, development section. Highly sophisticated and proper services can be provided quickly.

The status database 111 and setting database 112 may be provided not to the personal computer 100 but to the monitor center 702. In this case, the personal computer 100 may be used as a client and the monitor center 702 is used as a Web server and database server to constitute a three-hierarchical-level Web system. By using a simple three-hierarchical-level system, development tools can be provided abundantly so that an application development efficiency of users can be improved and multimedia such as images, graphs, audio and video data can be processed more easily. If the client personal computer 100 provided with a Web browser transfers data in the HTML or XML format to and from the Web server monitor center 702 and the monitor center 702 stores Java applets, then it is possible to download data to the personal computer 100 via HTTP and allow the personal computer 100 to perform more sophisticated data processing and display. If the monitor center 702 is allowed to inquire the state database 111 or setting database 112 by using CGI, the Web browser personal computer 100 can form a more interactive Web page.

The application program refers only the database and updates control data. Therefore, different application fields such as a monitor dedicated system, a control dedicated system and a maintenance dedicated system can be easily realized only through alteration or version-up of the application without changing the hardware and software configuration. If the database and its specification are made public (sold), each user can develop a desired application.

Since a portion to be changed when a new type of an air conditioner is added can be reduced, the time required for such change can be shortened and management of data specific to each machine type becomes easy. The maintenance performance of the management system itself can therefore be improved.

As described so far, according to the embodiment, an open network environment and a multi vendor system for an air conditioner such as a multi air conditioner can be realized so that management and services can be made highly efficient and a management system excellent in system expendability, maintenance and reliability can be provided.

What is claimed is:

1. A discrete converter unit connectable to a monitor apparatus and an air conditioner for monitoring and controlling the air conditioner, the air conditioner including an indoor machine and an outdoor machine to effect a refrigerating cycle, the indoor machine and the outdoor machine being connected with each other via a transmission path, comprising:

air conditioner transmission software for transmitting a setting-control data determined by the monitor apparatus regarding a running start/stop state, a running mode, an air quality and a temperature, respectively of the air conditioner, to the transmission path, and for receiving running data regarding a temperature and a pressure from the transmission path;

USB transmission software for receiving the setting-control data via an USB from the monitor apparatus, and for transmitting the running data via USB-formatting to the monitor apparatus via the USB; and a converter to convert non-USB-formatting of the running data received via the air conditioner transmission software to USB-formatting for the USB transmission software, and to convert USB-formatting of the setting-control data received via the USB transmission software to non-USB-formatting for the air conditioner transmission software, respectively, and wherein the setting-control data having the non-USB-formatting is transmitted to the transmission path if a setting value of the setting-control data having USB-formatting is changed.

2. A converter unit according to claim 1, wherein, between the indoor machine and the outdoor machine, a control message is controlled respectively on the basis of a basic format and change data.

3. A discrete converter bridge unit connected to a monitor apparatus and an air conditioner, for monitoring and controlling the air conditioner, with the air conditioner including an indoor machine and an outdoor machine to effect a refrigerating cycle, the indoor machine and the outdoor machine being connected to each other via a transmission path, comprising:

air conditioner transmission software for transmitting a setting-control data determined by the monitor apparatus regarding a running start/stop state, a running mode, an air quality and a temperature, respectively of the air conditioner, to the transmission path, and for receiving running data regarding a temperature and a pressure from the transmission path, wherein the setting-control data transmitted to the transmission path and the running data received from the transmission path, are embodied in accordance with a non-USB-formatting data protocol;

USB transmission software for receiving the setting-control data from the monitor apparatus via a USB and transmitting the running data via USB-formatting to the monitor apparatus via the USB, wherein the setting-control data from the monitor apparatus and the running data transmitted to the monitor apparatus, are embodied in accordance with a USB-formatting data protocol differing from the non-USB-formatting data protocol; and a converter bridge to convert the running data having the non-USB-formatting data protocol to the USB-format ting data protocol for the USB transmission software, and to convert the setting-control data having the USB-formatting data protocol to the non-USB-formatting data protocol for the air conditioner transmission software, respectively, wherein the setting-control data having the non-USB-formatting data protocol is transmitted to the transmission path if a setting value of the setting-control data having USB-formatting is changed.

4. A converter unit according to claim 3, wherein the USB transmission software is associated with a USB interface handling data according to the USB-formatting data protocol.

5. A converter unit according to claim 3, wherein, between the indoor machine and the outdoor machine, a control message is controlled respectively on the basis of a basic format and change data.

* * * * *